United States Patent [19]

Onoue

[11] Patent Number: 4,917,639

[45] Date of Patent: Apr. 17, 1990

[54] DEVICE FOR SUPPORTING DRIVE SHAFT OF MARINE PROPULSION UNIT

[75] Inventor: Akihiro Onoue, Hamamatsu, Japan

[73] Assignee: SanshinKogyo Kabushiki Kaisha, Hamamatsu, Japan

[21] Appl. No.: 158,218

[22] Filed: Feb. 19, 1988

[30] Foreign Application Priority Data

Feb. 24, 1987 [JP] Japan ..... 62-39255

[51] Int. Cl.[4] ..... B63H 21/38

[52] U.S. Cl. ..... 440/88; 384/563; 384/620; 415/140; 440/76; 440/78; 440/83

[58] Field of Search ..... 440/75, 79, 76, 78, 440/900, 88, 83; 415/107, 140; 384/611, 620, 563

[56] References Cited

U.S. PATENT DOCUMENTS

| | | | |
|---|---|---|---|
| 1,752,366 | 4/1930 | Brown | 415/140 |
| 2,206,488 | 7/1940 | Pavlecka et al. | 415/140 |
| 2,438,442 | 3/1948 | Holt | 415/140 |
| 2,736,617 | 2/1956 | Lippmann | 384/563 |
| 4,650,430 | 3/1987 | Schiek | 440/83 |
| 4,673,359 | 6/1987 | Gust | 440/88 |
| 4,767,225 | 8/1988 | Iio | 384/616 |

FOREIGN PATENT DOCUMENTS

| | | | |
|---|---|---|---|
| 119992 | 9/1980 | Japan | 440/88 |
| 79093 | 6/1981 | Japan | 440/88 |
| 61-47798 | 3/1986 | Japan . | |

*Primary Examiner*—Sherman D. Basinger
*Assistant Examiner*—Thomas J. Brahan
*Attorney, Agent, or Firm*—Ernest A. Beutler

[57] ABSTRACT

A device for supporting the drive shaft of a marine propulsion unit wherein a single thrust bearing that supports the drive shaft against its thrust loads is biased by means of an elastic connection between the water pump and the drive shaft for simplifying the construction and eliminating the necessity for separate biasing springs for this purpose.

6 Claims, 3 Drawing Sheets

DEVICE FOR SUPPORTING DRIVE SHAFT OF MARINE PROPULSION UNIT

BACKGROUND OF THE INVENTION

This invention relates to a device for supporting the drive of a marine propulsion unit and more particularly to an improved, simplified drive shaft support for such units.

As is well known, most marine outboard drive units (either the outboard drive portion of an inboard/outboard drive or an outboard motor per se) employ a drive shaft that rotates about a vertically extending axis and which is driven by an internal combustion engine or other prime mover. A gearing arrangement (normally bevel gears) at the lower end of the drive shaft transmits drive from the drive shaft to the propulsion device such as the propeller and propeller shaft. Frequently, a forward neutral reverse transmission is incorporated in this gearing connection.

It is the general practice to provide a thrust bearing between the lower unit outer housing and the drive shaft for taking the normal thrust forces on the drive shaft. In accordance with outboard drive conditions, however, it is well known that the driving thrusts tend to fluctuate quite widely in an outboard drive unit and hence the drive shaft will receive thrust loadings in both directions. These reversing thrusts can cause axial movement between the drive shaft and supporting housing and, accordingly, generate noise.

In order to avoid such noises as are generated by the fluctuating thrust forces, it has been the practice to provide a relatively large diameter coil spring that encircles the drive shaft and which acts between the drive shaft and drive shaft housing for urging the thrust faces of the thrust bearing into engagement with each other. Such an arrangement, however, has several disadvantages. First, the coil spring is relatively large in diameter and this can increase the diameter of the lower unit and, accordingly, adversely effect its flow resistance in the water. In addition, it is difficult to obtain the necessary biasing forces with such single coil springs.

As shown in copending application Ser. No. 66,818, entitled Drive Shaft Supporting Device for Marine Propulsion Engine, filed June 25, 1987 in my name, which application is assigned to the assignee of this application, there is disclosed one alternative supporting arrangement that offsets the deficiencies of the prior art discussed above. Although this construction has several advantages and does overcome the noted problems, further improvements are possible.

It is, therefore, a principal object of this invention to provide an improved device for supporting the drive of a marine propulsion unit.

It is another object of this invention to provide an improved supporting arrangement for a marine propulsion drive shaft wherein the use of coil springs is eliminated.

It is yet another object of this invention to provide a marine propulsion drive shaft supporting arrangement that can be utilized with conventional marine drives without necessitating significant changes in their basic structure.

SUMMARY OF THE INVENTION

This invention is adapted to be embodied in a marine outboard drive that is comprised of an outer housing, a drive shaft journaled within the outer housing for driving a marine propulsion device and a thrust bearing which is interposed between the outer housing and the drive shaft for supporting the drive shaft against thrust forces in at least one direction. A pump housing is affixed within the outer housing and defines a pumping cavity which pumping cavity is defined by a surface that faces in a direction extending axially of the drive shaft. A pumping element is drivingly connected to the drive shaft and contained within the pumping cavity for pumping fluids upon rotation of the drive shaft. The driving connection includes a resilient element connected between the pumping element and the drive shaft and which biases the drive shaft in a direction so as to maintain the thrust bearing under load.

DETAILED DESCRIPTION OF THE PREFERRED EMBODIMENTS OF THE INVENTION

Figure 1:
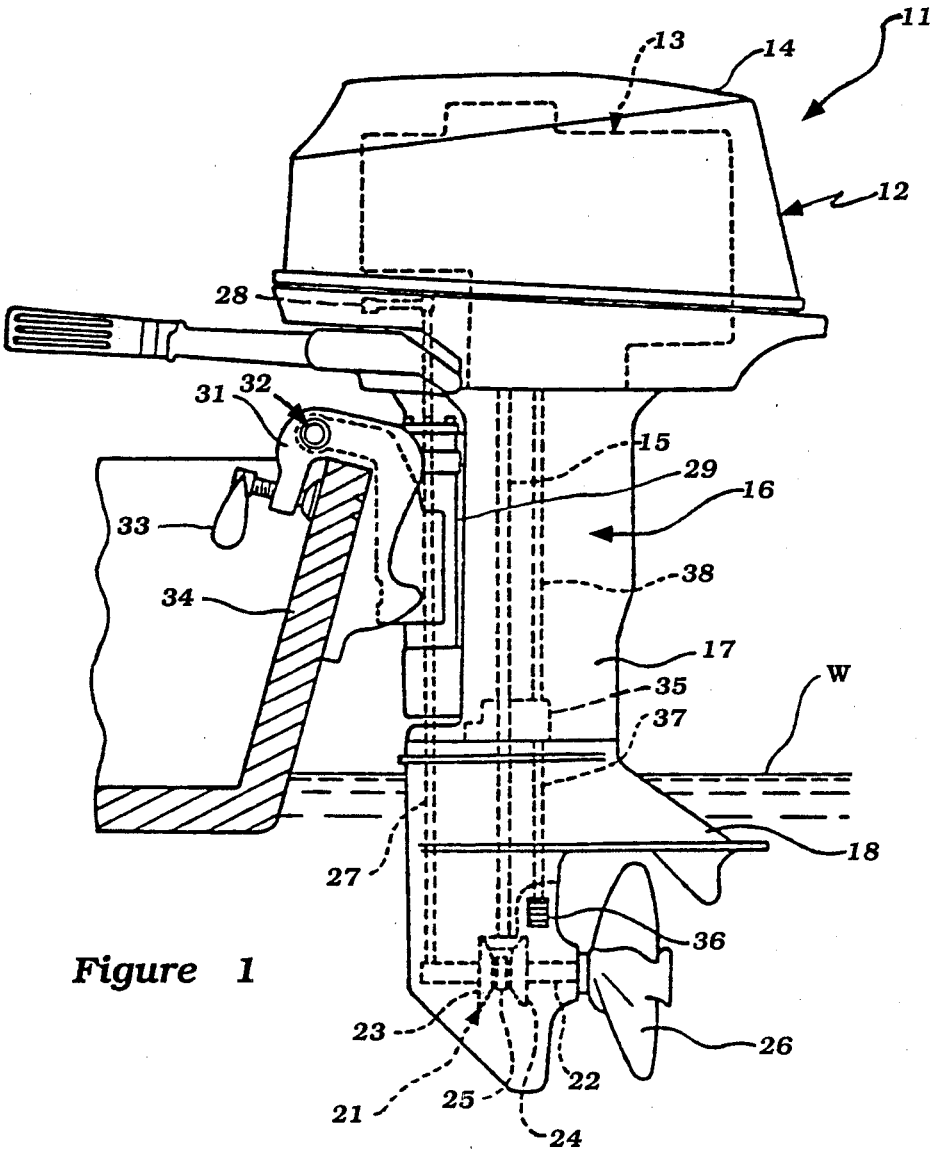
FIG. 1 is a side elevational view of an outboard motor constructed in accordance with an embodiment of the invention as attached to the transom of an associated watercraft, which watercraft is shown only partially and in cross-section.

Referring first primarily to FIG. 1, an outboard motor constructed in accordance with an embodiment of the invention is identified generally by the reference numeral 11. Although the invention is described in conjunction with an outboard motor, it is to be understood that the invention may be equally as well practiced with the outboard drive portion of an inboard/-outboard drive. The outboard motor 11 is comprised of a power head assembly, indicated generally by the reference numeral 12 and which is comprised of a powering internal combustion engine 13 and a surrounding protective cowling 14. The engine 13 may be of any type, is water cooled, and has its output shaft rotating about a generally vertically extending axis, as is normal with outboard motor practice.

The output shaft of the engine 13 is drivingly connected to a drive shaft 15 that is supported for rotation about a vertically extending axis within a drive shaft housing assembly, indicated generally by the reference numeral 16. The drive shaft housing assembly 16 includes an outer housing 17 which is generally formed as a casting from a light weight metal such as aluminum. The supporting arrangement for the drive shaft 15 will be described by particular reference to FIGS. 2 and 3, as this description proceeds.

A lower unit 18 extends from the lower portion of the drive shaft housing 16 and contains a driving pinion gear 19 that is affixed to the lower end of the drive shaft 15. The pinion gear 19, which is of the bevel type, forms a portion of a forward neutral reverse transmission, indicated generally by the reference numeral 21 which is incorporated for driving a propeller shaft 22 that is journaled within the lower unit 18 in a known manner. In addition to the pinion gear 19, the forward neutral reverse transmission 21 includes a pair of counter rotating bevel gears 23 and 24 which are journaled on the propeller shaft 22 in a known manner. A dog clutching element 25 is incorporated for selectively coupling the gears 23 or 24 to the propeller shaft 22 for rotating it in a forward or reverse direction. A propeller 26 is affixed to the propeller shaft 22 for propulsion, as is well known in this art.

A shift rod 27 extends vertically through the lower unit 18 and drive shaft housing 17 and is coupled to a shift lever 28 at its upper end for effecting shifting of the transmission 21.

The drive shaft housing 16 supports a steering shaft (not shown) in a known manner and which steering shaft is journaled for steering movement about a generally vertically extending steering axis in a swivel bracket assembly 29. The swivel bracket assembly 29 is, in turn, pivotally connected to a clamping bracket 31 by means of a pivot pin 32 for tilting movement of the outboard motor 11. The clamping bracket 31 includes a clamping device 33 for affixing the outboard motor 11 to a transom 34 of an associated watercraft.

In addition to the construction already described, the outboard motor 11 further includes a water pump 35 that is supported within the drive shaft housing outer casing 17 against its interface with the lower unit 18 and slightly above the normal water line, "W". The water pump 18 draws water from the body of water W through a coolant inlet 36 formed in the lower unit 18 and a conduit 37. Pressurized coolant is delivered to the engine cooling jacket through a delivery conduit 38 that extends upwardly through the drive shaft housing 16. The coolant which has been circulated through the engine cooling jacket is returned to the body of water in which the watercraft is operating through a suitable water discharge.

The construction of the outboard motor 11 as thus far described may be considered to be conventional and, for that reason, further details of its construction are not believed to be necessary to understand the construction and operation of the invention.

Figure 2:
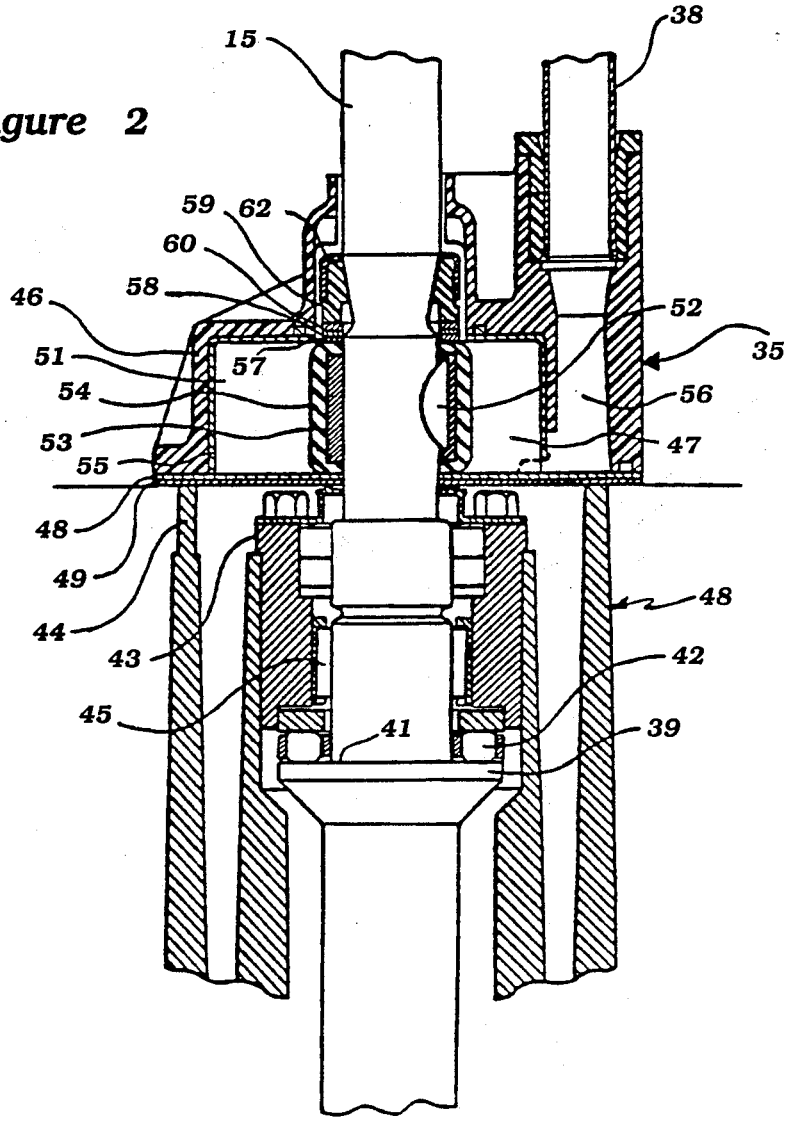
FIG. 2 is an enlarged cross-sectional view showing the construction of the supporting arrangement for the drive shaft.

The supporting and thrust taking arrangement for the drive shaft 15 will now be described by particular reference to FIGS. 2 and 3. As seen in FIG. 2, the lower end of the drive shaft 15 is provided with an enlarged portion 39 that defines an upwardly facing shoulder 41 that is engaged with a thrust bearing 42. The thrust bearing 42 is, in turn, engaged with a lower shoulder of a bearing housing 43 that is affixed to a casing 44 of the lower unit 18. The normal driving thrusts on the drive shaft 15 tend to force it upwardly in the lower unit 18 and thus the thrust bearing 42 takes these normal driving thrusts. A needle bearing 45 is also supported within the bearing carrier 43 and radially supports the lower end of the drive shaft 15.

There is not normally a thrust bearing to support the drive shaft 15 against downward thrust loads since loads do not normally occur in this direction. However, the pulsations in the output of the driving engine 13 and speed variations may cause the upward thrust to vary and thus change the loading on the thrust bearing 42. In order to prevent noise under this occurrence, a biasing arrangement is incorporated within the water pump 35 so as to maintain a constant upward thrust on the drive shaft 15 so as to prevent noise under these circumstances.

In accordance with normal outboard motor practice, the water pump 13 is positioned at the interface between the lower end of the drive shaft housing casing 17 and the upper end of the lower unit casing 44. The water pump 35 includes a water pump casing 46 that is positioned at this interface and is affixed relative to the drive shaft housing casing 17 in a suitable manner. The water pump housing 46 defines a pumping cavity 47 which is defined at its lower extremity by a closure plate 48 that is positioned between the pump housing 46 and the lower unit casing 44. A gasket 49 is interposed at this surface for sealing purposes.

Figure 3:
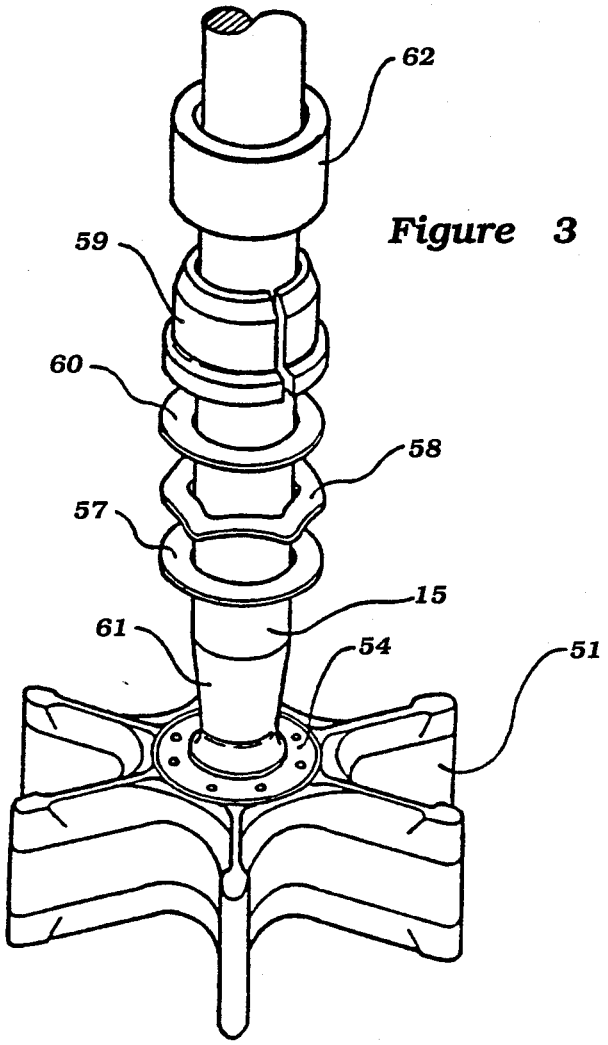
FIG. 3 is an enlarged, partially exploded, perspective view showing a portion of the structure illustrated in FIG. 2.

Supported within the pumping cavity 47 is an impeller 51 having a configuration as best shown in FIG. 3. The impeller 51 is connected for rotation with the drive shaft 15 by means including a key 52. In addition, there is provided a resilient coupling between the drive shaft 15 and impeller 51. This resilient coupling includes an inner sleeve 53 with which the key 52 cooperates. The inner sleeve 53 is joined to the main body of the impeller 51 by an elastomeric sleeve 54. The elastomeric sleeve 54 is designed so as to be yieldable in an axial direction so as to provide a resilient biasing force on the drive shaft 15, in a manner to be described.

The impeller 51 cooperates with an insert sleeve 55 fixed within the pump housing 46 so that rotation of the impeller 51 in the pumping cavity 47 will force fluid from the inlet to an outlet chamber 56 that communicates with the discharge conduit 38 for delivering pumped coolant to the engine.

The upper end of the elastic sleeve 54 bears against a metal washer 57 which, in turn, bears against a wave type washer 58. The wave type washer 58, in turn, bears against a split synthetic bushing 59 through a further washer 60. The bushing 59 has a tapered opening which cooperates with a tapered surface 62 on the drive shaft 15 so as to transmit axial forces from the elastomeric sleeve 54 through the washer 57, wave washer 58, and washer 60 to the busing 59 and drive shaft 15. An annular cup shape member 62 encircles the split bushing 59 and acts so as to permit the busing 59 to act as a one-way device so as to permit the drive shaft 15 to move axially upwardly relative to the bushing 59 but which will not permit the bushing 59 to slip axially upwardly relative to the drive shaft 15. In this way, there is ensured a constant loading at an upward direction on the drive shaft 15.

Therefore, it should be readily apparent that the described construction permits the desired loading on the thrust bearing 42 and ensures that noise will not occur due to torque or other fluctuations in the axial loading on the drive shaft 15. The elastic bushing 54 provides the bulk of the axial force although the wave washer 58 may also cooperate in this regard. However, the wave washer 58 may be deleted if desired.

It should also be noted that the described construction does not require any modifications in the construction of the lower unit or drive shaft housing but can all be formed internally within the water pump 35. As a result, this arrangement may be used with existing outboard drives without necessitating any variation or change in their basic construction.

It is to be understood that the foregoing description is that of the preferred embodiments of the invention and that various changes in modifications may be made without departing from the spirit and scope of the invention, as defined by the appended claims.

I claim:

1. In a marine outboard drive comprised of an outer housing, a drive shaft journaled within said outer housing for driving a marine propulsion device, a thrust bearing interposed between said outer housing and said drive shaft for supporting said drive shaft against thrust forces in at least one direction, a pump housing affixed within said outer housing and defining a pumping cavity, said pumping cavity being defined by a surface facing in a direction extending axially of said drive shaft, a pumping element drivingly connected to said drive shaft and contained within said pumping cavity, said driving connection comprising a resilient element connecting said pumping element to said drive shaft and permitting relative axial movement therebetween when not axially loaded, said resilient element exerting an axial force on said drive shaft relative to said pumping element for maintaining the thrust forces on the drive shaft in the one direction when installed and under load.

2. In a marine outboard drive as set forth in claim 1 wherein the pumping element supplies coolant to the powering engine of the outboard drive which drives the drive shaft.

3. In a marine outboard drive as set forth in claim 1 further including a lower unit containing propulsion means driven by the drive shaft for powering the associated watercraft, the pump housing being affixed within the outer housing and at interface with the lower unit.

4. In a marine outboard drive as set forth in claim 3 wherein the pumping element supplies coolant to the powering engine of the outboard drive which drives the drive shaft.

5. In a marine outboard drive as set forth in claim 1 wherein the pumping element is in engagement with the surface facing in an axial direction and the connection of the resilient element to the drive shaft exerts an axial force on the drive shaft perpendicular to the surface.

6. In a marine outboard drive as set forth in claim 5 wherein the resilient element comprises an annular bushing encircling the drive shaft and interposed between the drive shaft and the pumping element.

* * * * *